US010815940B2

(12) United States Patent
Lohmann

(10) Patent No.: US 10,815,940 B2
(45) Date of Patent: Oct. 27, 2020

(54) INTAKE MANIFOLD WITH INTEGRATED MIXER

(71) Applicant: Deere & Company, Moline, IL (US)

(72) Inventor: Craig W. Lohmann, Cedar Falls, IA (US)

(73) Assignee: DEERE & COMPANY, Moline, IL (US)

( * ) Notice: Subject to any disclaimer, the term of this patent is extended or adjusted under 35 U.S.C. 154(b) by 96 days.

(21) Appl. No.: 16/038,849

(22) Filed: Jul. 18, 2018

(65) Prior Publication Data

US 2020/0025159 A1 Jan. 23, 2020

(51) Int. Cl.

| | |
|---|---|
| ***F02M 26/19*** | (2016.01) |
| ***F02M 35/10*** | (2006.01) |
| ***F02M 35/104*** | (2006.01) |
| ***F02M 26/40*** | (2016.01) |

(52) U.S. Cl.

CPC ..... *F02M 26/19* (2016.02); *F02M 35/104* (2013.01); *F02M 35/10045* (2013.01); *F02M 35/10222* (2013.01); *F02M 26/40* (2016.02)

(58) Field of Classification Search

CPC ..... F02M 26/19; F02M 35/10222; F02M 35/104; F02M 35/10045; F02M 26/40; F02D 41/0072; F02D 41/0077; F02D 41/0065

USPC ..... 123/568.17

See application file for complete search history.

(56) References Cited

U.S. PATENT DOCUMENTS

| | | | | |
|---|---|---|---|---|
| 2007/0039597 | A1* | 2/2007 | Zukouski | F02M 35/10222 123/568.17 |
| 2008/0264060 | A1* | 10/2008 | Carlsson | H04L 27/2601 60/605.2 |
| 2012/0000447 | A1* | 1/2012 | Elsasser | F02D 41/0002 123/568.11 |
| 2012/0204845 | A1* | 8/2012 | Gingrich | F02M 26/43 123/568.17 |
| 2012/0216530 | A1* | 8/2012 | Flynn | F02M 35/10222 60/605.2 |
| 2015/0020781 | A1* | 1/2015 | Keating | F02M 35/10222 123/568.11 |
| 2017/0138319 | A1* | 5/2017 | Zurlo | F02M 26/50 |

* cited by examiner

*Primary Examiner* — Joseph J Dallo
*Assistant Examiner* — Scott A Reinbold
(74) *Attorney, Agent, or Firm* — Michael Best & Friedrich LLP

(57) ABSTRACT

A manifold for use with an internal combustion engine defining at least one cylinder and an EGR circuit, the manifold including a first chamber having an inlet and an outlet, where the outlet is open to the cylinder, and a second chamber having a first port open to the first chamber, a second port open to the first chamber downstream of the first port, and a third port open to the EGR circuit.

11 Claims, 5 Drawing Sheets

INTAKE MANIFOLD WITH INTEGRATED MIXER

FIELD OF THE INVENTION

The present disclosure relates to an intake manifold and more specifically an intake manifold that includes an integrated mixer.

BACKGROUND

Integrating EGR gas into intake air can be difficult given the pulsating nature of the EGR gas flow. More specifically, the uneven introduction of EGR gas into the intake air can cause the mixed gas provided to the cylinders to have large variations in EGR gas concentration. This variation, in turn, causes wide differences in the net amounts of EGR gas distributed to each cylinder, effecting engine efficiency.

SUMMARY

In one aspect, a manifold for use with an internal combustion engine defining at least one cylinder and an EGR circuit, the manifold including a first chamber having an inlet and an outlet, where the outlet is open to the cylinder, and a second chamber having a first port open to the first chamber, a second port open to the first chamber downstream of the first port, and a third port open to the EGR circuit.

In another aspect, a manifold for use with an internal combustion engine including at least one cylinder and an EGR circuit, the manifold including a body having an outer wall at least partially defining a channel therethrough, a baffle at least partially positioned within the channel to divide the channel into a first chamber and a second chamber, where the baffle at least partially defines a first port open to both the first chamber and the second chamber, and where the baffle at least partially defines a second port positioned downstream of the first port and open to both the first chamber and the second chamber. The manifold also including an inlet open to both the EGR circuit and the second chamber, and an outlet open to both the at least one cylinder and the first chamber.

In another aspect, a manifold for use with an internal combustion engine including a cylinder and an EGR circuit, the manifold including a first chamber having an inlet and an outlet, where the outlet is open to the cylinder of the internal combustion engine, a second chamber having a first port open to the first chamber, a second port open to the first chamber, and a third port in fluid communication with the EGR circuit, where the manifold is configured to produce a first flow pattern and a second flow pattern different than the first flow pattern based at least in part on the flow rate of gasses within the EGR circuit.

Other aspects of the disclosure will become apparent by consideration of the detailed description and accompanying drawings.

DETAILED DESCRIPTION

Figure 1:
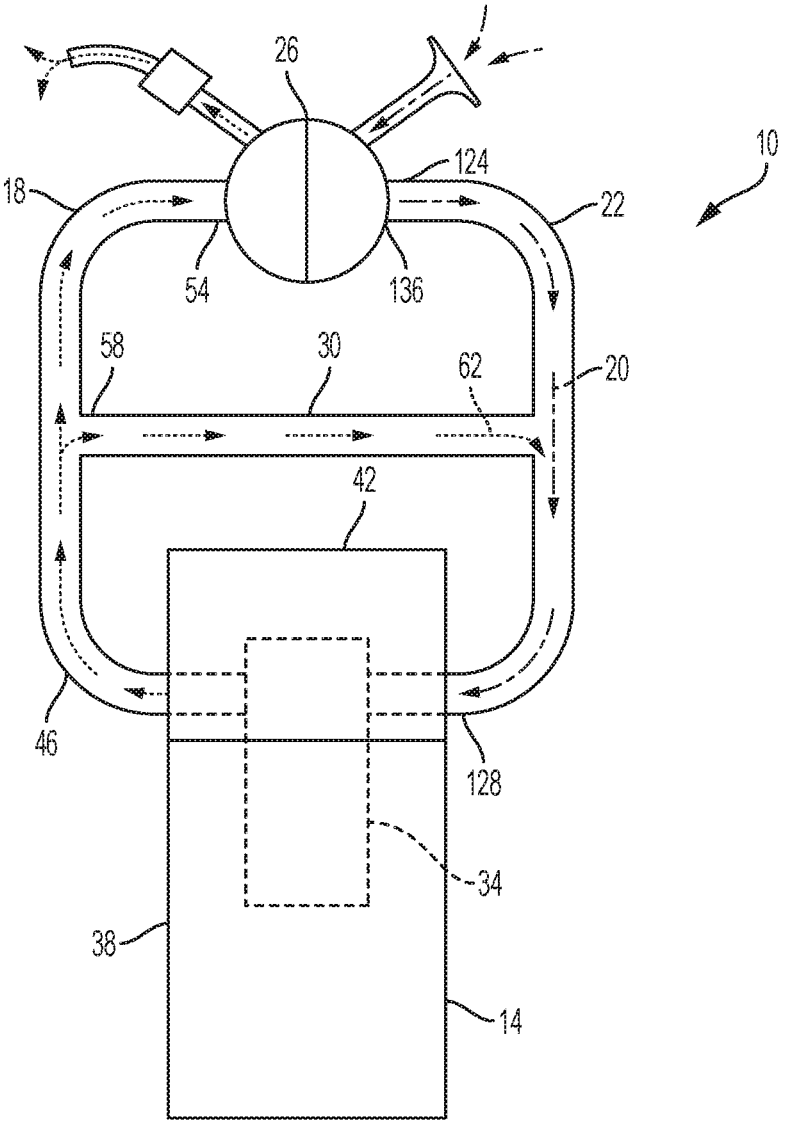
FIG. 1 is a schematic view of the engine assembly with the integrated mixer attached thereto.

Before any embodiments of the disclosure are explained in detail, it is to be understood that the disclosure is not limited in its application to the details of the formation and arrangement of components set forth in the following description or illustrated in the accompanying drawings. The disclosure is capable of supporting other implementations and of being practiced or of being carried out in various ways.

The disclosure relates to intake manifolds and more particularly to intake manifolds having an integrated mixer configured to mix the exhaust gases from the EGR circuit with the intake air from the turbocharger or carburetor such that the resulting flow of mixed gasses has a more even distribution of exhaust gasses than the "pulsating" and cyclical nature of the corresponding EGR circuit.

FIGS. 1-3B illustrate an engine assembly 10. The engine assembly 10 includes an internal combustion engine 14, an exhaust assembly 18 coupled to the engine 14, an intake assembly 22 coupled to the engine 14, a turbocharger 26 coupled to and in operable communication with the intake assembly 22 and the exhaust assembly 18, and an exhaust gas recirculation (EGR) circuit 30. During operation, the internal combustion engine 14 produces exhaust gasses which are directed into the turbocharger 26 by the exhaust assembly 18. The turbocharger 26, in turn, uses the energy provided by the exhaust gasses to produce and direct a first flow 20 of intake air (e.g., compressed atmospheric gasses) into the engine 14 via the intake assembly 22. Furthermore, a portion of the exhaust gasses are drawn from the exhaust assembly 18 and recirculated into the intake assembly 22 via the EGR circuit 30. The intake assembly 22 then mixes the recirculated exhaust gasses from the EGR circuit 30 with the first flow 20 of compressed atmospheric gas produced by the turbocharger 26 and directs the resulting mixed gases into the cylinders 34 of the internal combustion engine 14 (described below).

The internal combustion engine 14 of the engine assembly 10 includes an engine block 38 and one or more cylinder heads 42 coupled to the engine block 38 to at least partially define one or more cylinders 34 therein. In the illustrated implementation, the engine 14 is an inline-6 engine defining six cylinders 34; however, in alternative implementations various engine styles and layouts may be used (e.g., I-4, V-8, V-6, flat-6, and the like).

The exhaust assembly 18 of the engine assembly 10 includes an exhaust manifold or header 46 as is well known in the art. The exhaust manifold 46 includes a plurality of secondary pipes, each in fluid communication with a corresponding cylinder 34 and configured to direct the corresponding exhaust gasses into the turbine inlet 54 of the turbocharger 26.

In the illustrated implementation, the exhaust assembly 18 includes an EGR port 58. During use, a portion of the exhaust gasses within the exhaust assembly 18 is drawn out of the manifold 46 and re-directed into the EGR circuit 30 where it can be recirculated through the engine 14 as is well known in the art.

Illustrated in FIG. 1, the EGR circuit 30 of the engine assembly 10 is in fluid communication with the EGR port 58 of the exhaust assembly 18 and is configured to recirculate a portion of the exhaust gasses back into the intake assembly 22 in the form of an EGR or second flow 62. While not shown, the EGR circuit 30 of the system 10 may also include an EGR valve (not shown) to restrict the flow of gasses into the EGR circuit 30.

Figure 4:
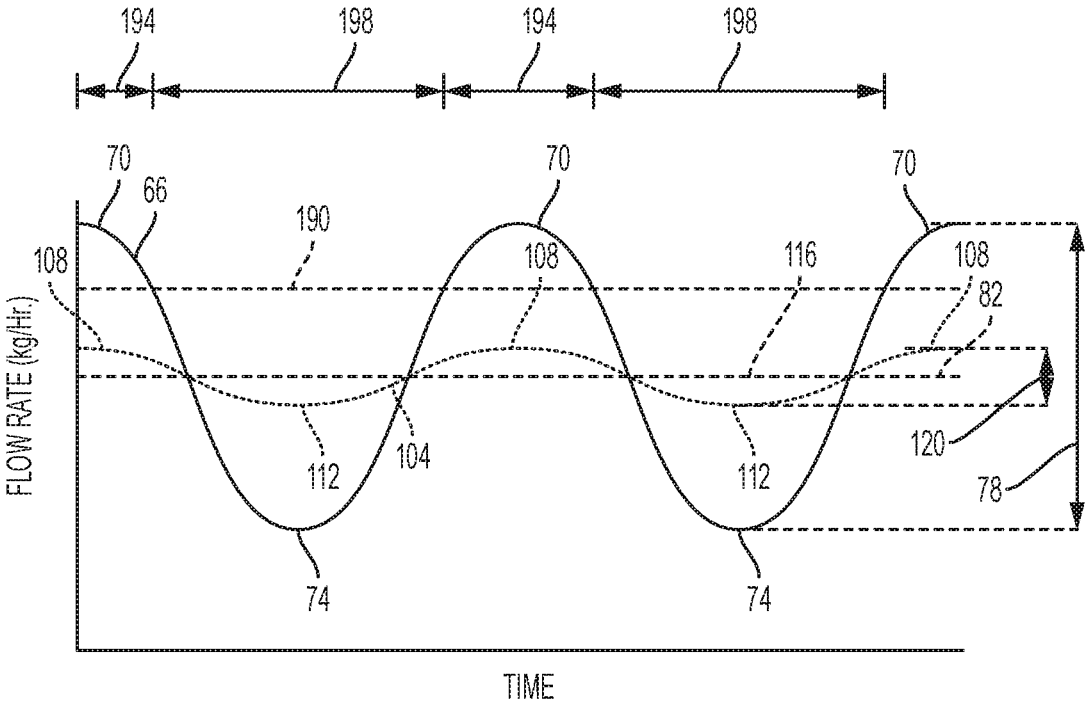
FIG. 4 illustrates the first flow profile and the second flow profile of the intake assembly.

During operation, the cylinders 34 of the internal combustion engine 14 produce exhaust gasses which are directed into the exhaust assembly 18 as described above. Due to the firing order and layout of the engine 14, the flow rate of exhaust gasses through the EGR circuit 30 produces a "pulsating" flow profile (see FIG. 4). More specifically, the flow rate of exhaust gasses through the EGR circuit 30 produces a first or EGR flow profile 66 (i.e., representing the flow rate of exhaust gasses in Kg/Hr flowing through the EGR circuit 30 over time). As shown in FIG. 4, the first flow profile 66 cyclically varies between a high flow rate 70, generally corresponding to the release of exhaust gasses from a particular cylinder, and a low flow rate 74, generally corresponding to the period of time between exhaust gas releases. Together, the high flow rate 70 and the low flow rate 74 produce a first EGR flow variance 78 and a first average EGR flow rate 82. For the purposes of this application, the EGR flow variance 78 is defined as the low flow rate 74 subtracted by the high flow rate 70 ($EGR_{VAR}=EGR_{HIGH}-EGR_{LOW}$).

The intake assembly 22 of the engine assembly 10 includes an elongated body 86 at least partially defining a first chamber 90 and a second chamber 94 therein. During use, the two chambers 90, 94 are configured to receive the first flow 20 of intake air from the turbocharger 26, receive the second flow 62 of recirculated exhaust gasses from the EGR circuit 30, and combine the first flow 20 with the second flow 62 to produce a third flow 100 of mixed gasses containing exhaust gasses forming a second flow profile 104 different from the first flow profile 66 with the second flow profile 104 representing the flow rate of exhaust gasses in Kg/Hr flowing out of the first outlet 128 within the third flow 100 (described below).

As shown in FIG. 4, the second flow profile 104 cyclically varies between a high flow rate 108 and a low flow rate 112. Together, the high flow rate 108 and the low flow rate 112 produce a second flow variance 120 that is less than the first flow variance 78 of the first flow profile 66. The second flow profile 104 also produces a second average flow rate 116 that is substantially similar to the first average flow rate 82. In the illustrated implementation, the flow variance 120 of the second flow profile 104 is between approximately 50% and approximately 90% smaller than the flow variance 78 of the first flow profile 66. In other implementations, the flow variance 120 of the second flow profile 104 is between approximately 70% and approximately 85% smaller than the flow variance 78 of the first flow profile 66. In still other implementations, the flow variance 120 of the second flow profile 104 is approximately 80% smaller than the flow variance 78 of the first flow profile 66.

The first chamber 90 of the intake assembly 22 includes a first inlet 124, and a first outlet 128 downstream of the first inlet 124. The first chamber 90 also defines a flow axis 132 extending from the first inlet 124 to the first outlet 128 while being positioned proximate the cross-sectional center of the first chamber 90. When assembled, the first inlet 124 of the first chamber 90 is open to the compressor outlet 136 of the turbocharger 26 and configured to receive the first flow 20 of compressed atmospheric air therein (see FIG. 2A).

The first outlet 128 of the first chamber 90 is open to and configured to direct the combined third flow 100 into each of the corresponding cylinders 34 of the engine 14. In the illustrated implementation, the first outlet 128 includes a single opening (see FIG. 2A) directly coupled to the cylinder head 42 of the internal combustion engine 14. However in alternative implementations, the first outlet 128 of the first chamber 90 may include multiple, independent openings (not shown) to divide and direct the third flow 100 of combined gasses into each of the one or more cylinders 34 directly.

Figure 2A:
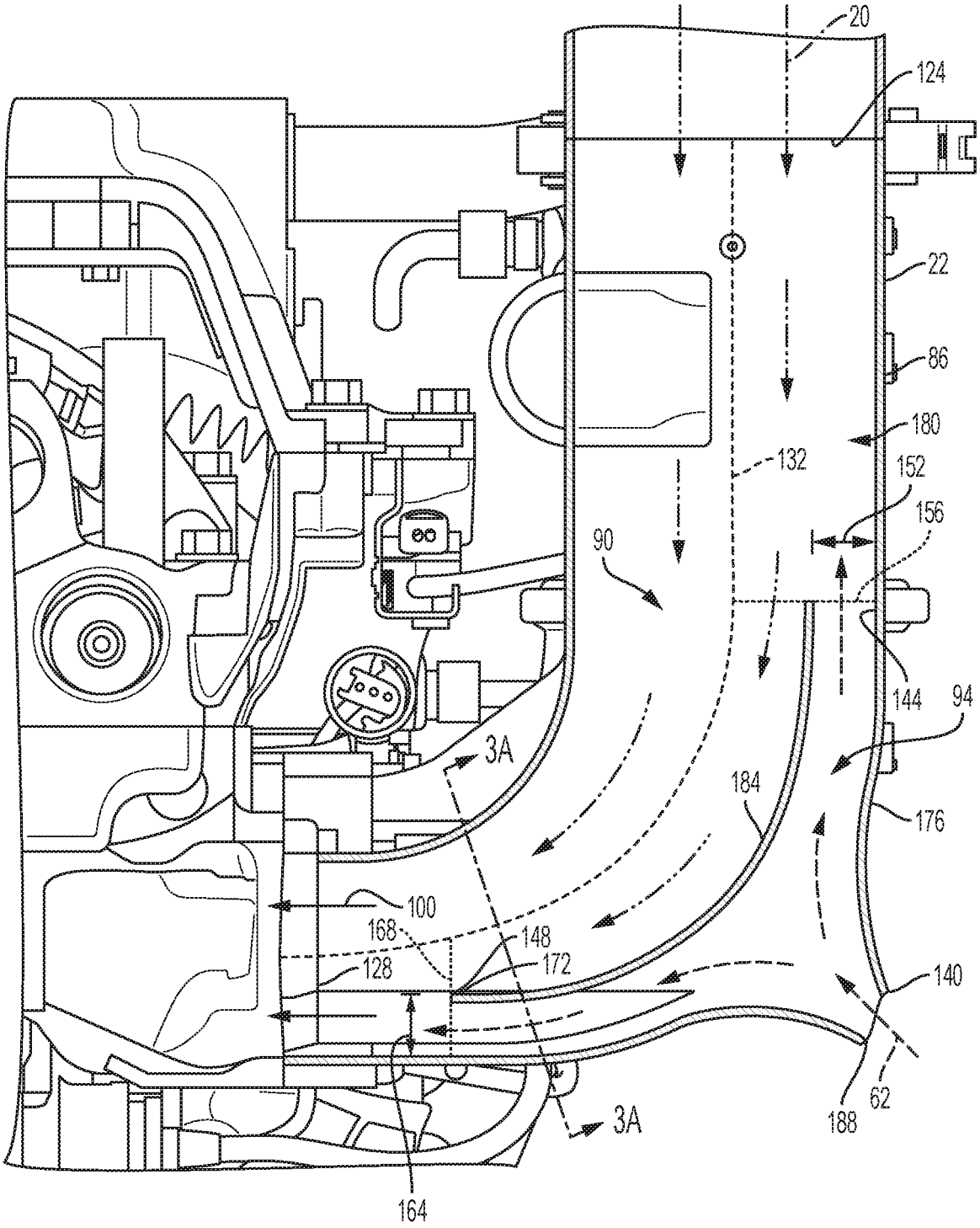
FIG. 2A is a side section view of the intake assembly with a first flow pattern.

The second chamber 94 of the intake assembly 22 includes an EGR or second inlet 140, a first port 144 open to the first chamber 90, and a second port 148 open to the first chamber 90 downstream the first port 144 (e.g., downstream from the first port 144 relative to the flow axis 132 of the first chamber 90, see FIG. 2A). As shown in FIGS. 1 and 2, the second inlet 140 of the second chamber 94 is open to the EGR circuit 30 and configured to receive the second flow 62 of recirculated exhaust gasses therein.

The first port 144 of the second chamber 94 is open to and allows gasses to flow between the first chamber 90 and the second chamber 94. In the illustrated implementation, the first port 144 defines a first port area 152 and a first port plane 156 generally coincident with the perimeter 160 of the first port 144. As shown in FIG. 2A, the first outlet plane 156 of the first port 144 is substantially perpendicular to the flow axis 132 and facing upstream such that gas flowing from the second chamber 94 into the first chamber 90 flows in a generally upstream direction (see FIG. 2A).

While the illustrated implementation includes a first port 144 that includes a single opening, it is to be understood that the first port 144 may include multiple, parallel openings allowing fluid flow between the first and second chambers 90, 94 at substantially the same position along the flow axis 132. In such implementations, the first outlet area 152 includes the combined area of each of the parallel openings.

The second port 148 of the second chamber 94 is open to and allows gasses to flow between the first chamber 90 and the second chamber 94 at a position downstream of the first port 144 measured relative to the flow axis 132 of the first chamber 90. In the illustrated implementation, the second port 148 defines a second outlet area 164 that is smaller than the first outlet area 152 of the first port 144. More specifically, the second outlet area 164 of the second port 148 is sized such that it will restrict the flow of gasses therethrough when the flow rate of the exhaust gasses entering the second chamber 94 via the second inlet 140 exceeds a predetermined flow limit 190 (see FIG. 4). In the illustrated implementation, the second port 148 is sized such that the predetermined flow limit 190 is greater than the low flow rate 74 of the EGR flow profile 66, and less than the high flow rate 70 of the EGR flow profile 66.

Furthermore, the second port 148 defines a second outlet plane 168 generally coincident with the perimeter 172 of the second port 148 that is substantially perpendicular to the flow axis 132 and faces downstream so that gas flowing from the second chamber 94 into the first chamber 90 flows in a generally downstream direction (see FIG. 2).

Figure 3A:
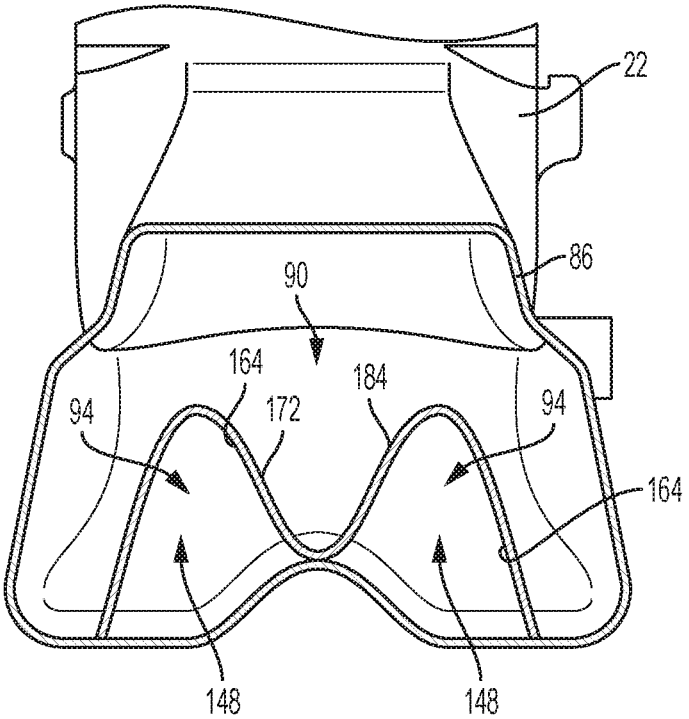
FIG. 3A is a section view taken along line 3-3 of FIG. 2A.
Figure 3B:
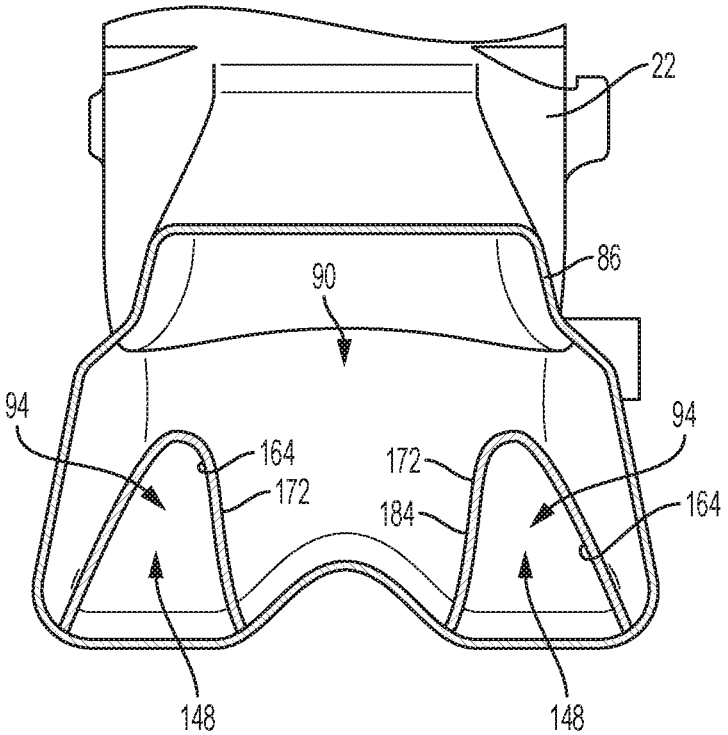
FIG. 3B is an alternative implementation of the layout of FIG. 3.

As shown in FIG. 3A, the second port 148 of the second chamber 94 includes multiple, parallel openings at substantially the same position along the flow axis 132. More specifically, each opening of the second port 148 is substantially triangular in cross-sectional shape to maximize the mixing of the exhaust gasses of the second flow 62 with the compressed atmospheric air of the first flow 20. As such, the second outlet area 164 includes the combined area of both parallel openings. As shown in FIGS. 3A and 3B, the multiple openings may be positioned adjacent one another (see FIG. 3A) or at opposite sides of the first chamber 90

(see FIG. 3B). In alternative implementations, the second port 148 may include a single opening (not shown).

In the illustrated implementation, the body 86 of the intake assembly 22 is substantially elongated in shape having a substantially cylindrical outer wall 176 defining a channel 180 extending therethrough. The channel 180, in turn, is open on both ends to form the first inlet 124 and the first outlet 128 of the first chamber 90. Furthermore, the body 86 of the intake assembly 22 forms a substantially "L" shape creating a substantially 90 degree elbow to alter the direction of flow (e.g., the flow axis 132) from a substantially vertical orientation to a substantially horizontal orientation (see FIG. 2A). However, in alternative implementations the body 86 may include any shape or size as is necessary to fluidly connect the compressor outlet 98 of the turbocharger 26 with the cylinder head 42 of the engine 14.

Illustrated in FIG. 2A, the body 86 of the intake assembly 22 also includes a baffle 184 at least partially positioned within the channel 180 and configured to separate the channel 180 into the first chamber 90 and the second chamber 94 and forming a common wall therebetween. More specifically, the baffle 184 is coupled to the wall 176 of the body 86 such that the gaps therebetween at least partially define the first port 144 and the second port 148. In the illustrated embodiment, the baffle 184 is positioned such that the second port 148 occupies approximately 20% to approximately 25% of the overall cross-sectional area of the channel 180 in that particular location along the flow axis 132 (e.g., the first chamber 90 occupies approximately 80% to approximately 75% of the overall cross-sectional area of the channel 180 in that particular location along the flow axis 132).

The body 86 of the intake assembly 22 also defines an aperture 188 in the outer wall 176 positioned between the first inlet 124 and the first outlet 128 to at least partially form the second inlet 140 therein. Still further, the aperture 188 is positioned such that it is also positioned between the first port 144 and the second port 148.

During operation of the engine assembly 10, a substantially continuous stream of intake air (e.g., the first flow 20) enters the first chamber 90 via the first inlet 124. Simultaneously, a "pulsating" flow of exhaust gasses (e.g., the second flow 62) enters the second chamber 94 via the second inlet 140. As described above, the pulsating nature of the second flow 62 is represented by a substantially cyclical first flow profile 66 alternating between an exhaust gas high flow rate 70 and an exhaust gas low flow rate 74 (see FIG. 4). The cyclical nature of the first flow profile 66, in turn, results in two different gas flow patterns being alternatingly produced within the intake assembly 22. More specifically, a first flow pattern 194 (see FIG. 2A) is produced when a relatively high flow rate of exhaust gas enters the second chamber 94 (e.g., the flow rate of the second flow 62 is above the predetermined flow limit 190; see FIG. 4), while a second flow pattern 198 (see FIG. 2B) is produced when a comparatively low flow rate of exhaust gas enters the second chamber 94 (e.g., the flow rate of the second flow 62 is below the predetermined flow limit 190; see FIG. 4).

As shown in FIG. 2A, the first flow pattern 194 occurs when the flow rate of exhaust gasses into the second chamber 94 (e.g., the second flow 62) exceeds the predetermined flow limit 190. In the first flow pattern 194, the exhaust gasses enter the second chamber 94 at a sufficiently high flow rate where the second port 148 restricts the flow of exhaust gasses therethrough. By doing so, a backpressure is created within the second chamber 94 as the chamber begins filling with exhaust gasses causing at least a portion of the second flow 62 to be directed out of the first port 148. As such, during the first flow pattern 194, the exhaust gasses of the second flow 62 flow out of the second chamber 94 and into the first chamber 90 via both the first port 144 and the second port 148. More specifically, exhaust gasses flow through the first port 144 at a first flow rate.

Figure 2B:
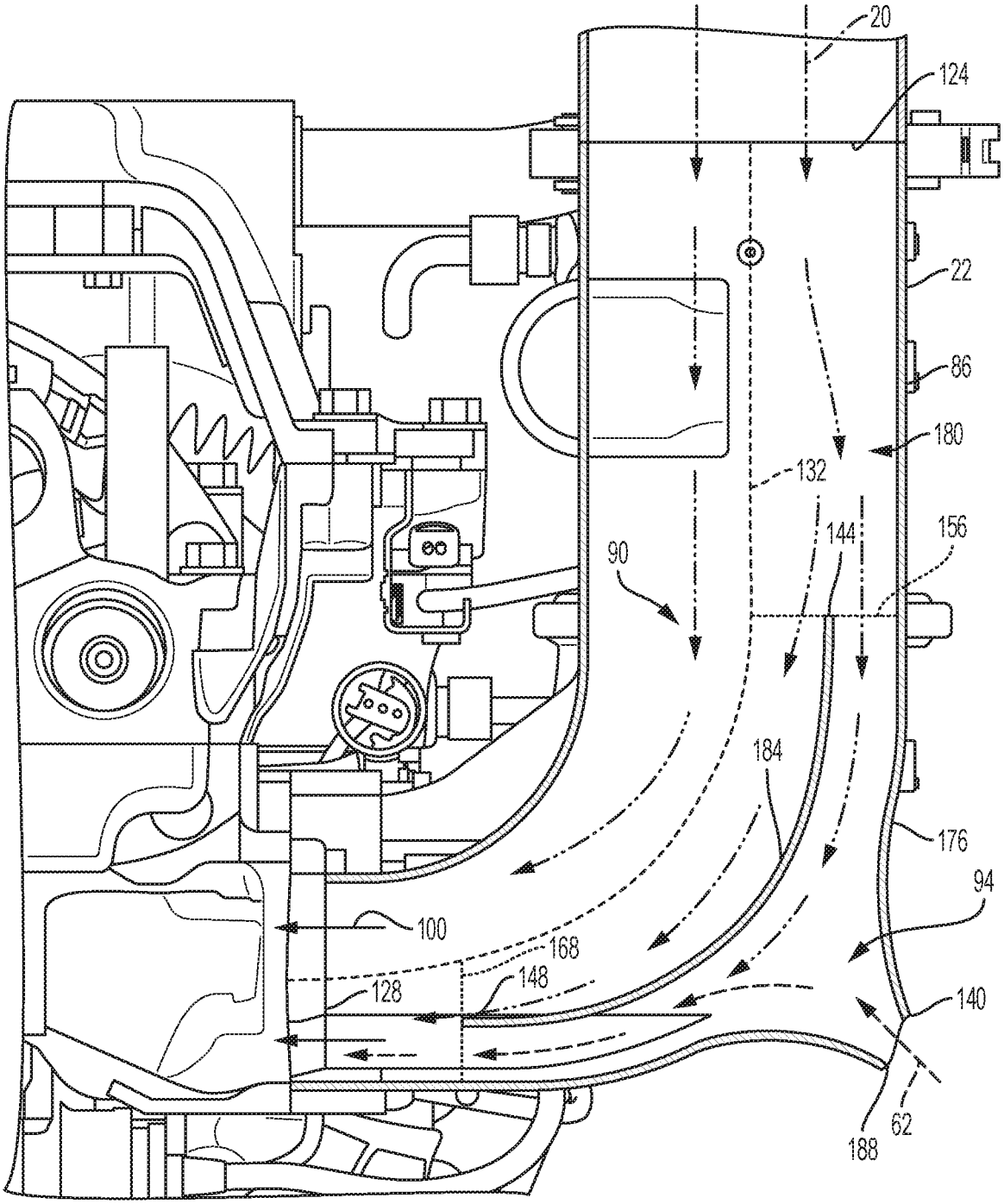
FIG. 2B illustrates the intake assembly of FIG. 2A with a second flow pattern.

As shown in FIG. 2B, the second flow pattern 198 occurs when the flow rate of exhaust gasses into the second chamber 94 (e.g., the second flow 62) is below the predetermined flow limit 190. In the second flow pattern 198, the exhaust gasses enter the second chamber 94 at a lower rate such that the second port 144 no longer restricts the flow of exhaust gasses therethrough. As such, no backpressure is created within the second chamber 94 allowing the first flow 20 of gas to enter the second chamber 94 via the first port 144. By doing so, the first flow 20 of gas is able to mix with and flush out any exhaust gasses contained within the second chamber 94 as the first flow 20 flows therethrough. During the second flow pattern 198, exhaust gasses flow through the second port 148 at a second flow rate less than the first flow rate (described above).

By alternating between the first flow pattern 194 and the second flow pattern 198 the intake assembly 22 is able to more evenly distribute the flow of exhaust gasses within the third flow 100 provided to the cylinders 34. More specifically, the backpressure provided by the second port 148 slows down the introduction of exhaust gasses into the first flow 20 when high levels of exhaust gasses are present in the EGR circuit 30 while the absence of that same backpressure when low levels of exhaust gasses are present in the EGR circuit 30 allows for quicker introduction of exhaust gasses into the first flow 20. The overall result is a more evenly mixed third flow 100 of gasses introduced into the cylinders 34 of the engine 14.

While the illustrated implementation includes an engine assembly 10 having a turbocharger 26, it is to be understood that in alternative implementations, the system 10 may be naturally aspirated, supercharged, and the like. In naturally aspirated implementations, the first flow 20 may include a mixture of fuel and atmospheric gasses. Still further, intercoolers or other elements may be present in the intake system 22 as necessary.

The invention claimed is:

1. A manifold for use with an internal combustion engine including a cylinder and an EGR circuit, the manifold comprising:

a first chamber having an inlet and an outlet, wherein the outlet is open to the cylinder of the internal combustion engine; and a second chamber having a first port open to the first chamber, a second port open to the first chamber, and a third port in fluid communication with the EGR circuit, wherein the manifold is configured to produce a first flow pattern and a second flow pattern different than the first flow pattern based at least in part on the flow rate of gasses within the EGR circuit, and wherein gas flows from the first chamber into the second chamber through the first port when the manifold produces the first flow pattern, and wherein gas flows from the second chamber into the first chamber through the first port when the manifold produces the second flow pattern.

2. The manifold of claim 1, wherein the first port is larger in area than the second port.

3. The manifold of claim 1, wherein the inlet of the first chamber is configured to receive compressed atmospheric air from a turbocharger.

4. The manifold of claim 1, wherein the first port defines a cross-sectional area that is between 20% and 25% of an average cross-sectional area of the first chamber.

5. The manifold of claim 1, wherein the second chamber and the first chamber share at least one common wall.

6. The manifold of claim 1, wherein the manifold includes a body having a cylindrical wall, and wherein both the first chamber and the second chamber are at least partially defined by the cylindrical wall.

7. The manifold of claim 1, wherein the third port is positioned between the first port and the second port.

8. The manifold of claim 1, wherein the second port is triangular in cross-sectional shape.

9. The manifold of claim 1, wherein gas flows from the second chamber into the first chamber through both the first port and the second port when the manifold produces the second flow pattern.

10. The manifold of claim 1, wherein the second port is downstream of the first port.

11. The manifold of claim 1, wherein manifold switches from the second flow pattern to the first flow pattern when the EGR circuit flow rate drops below a predetermined flow limit.

* * * * *